United States Patent [19]

Dutton

[11] 3,962,564

[45] June 8, 1976

[54] APPARATUS FOR COUNTING A STACK OF SHEETS

[75] Inventor: Gordon Stanley Dutton, Harwich, England

[73] Assignee: Vacuumatic Limited, England

[22] Filed: Sept. 19, 1974

[21] Appl. No.: 507,549

[52] U.S. Cl. ..... 235/92 SB; 235/92 R; 235/98 R; 271/107

[51] Int. Cl.² ..... G06M 9/00

[58] Field of Search ..... 235/92 SB, 98 R; 271/104, 107

[56] References Cited

UNITED STATES PATENTS 3,801,777 4/1974 Onoe et al. ..... 235/98 R

*Primary Examiner*—Joseph M. Thesz

*Attorney, Agent, or Firm*—Edward F. Connors

[57] ABSTRACT

There is disclosed apparatus, for counting a stack of sheets, of the kind (hereinafter referred to as "the kind described") comprising a counting head which in use is traversed along a corner of the stack, the head having a suction blade provided with a suction orifice for insertion in the corner of the stack, which blade is oscillatable about a horizontal axis to separate a corner of a sheet in the stack adhered by suction to one side of the blade from the next stack, and a wiping pin movable in an elongate orbit around the blade to transfer the corner of the sheet from the said one side of the blade to the opposite side thereof, and means to count the number of transfer operations effected, wherein there are provided means to traverse the counting head downwardly past a corner of a stack to be counted and means to move said wiping pin in a generally downwardly inclined elliptical orbit around the suction blade, comprising first means to mount the wiping pin for eccentric rotation about a first axis, second means to mount said first mounting means for eccentric rotation about a second axis, and means to drive said first and second mounting means about said first and second axes respectively.

5 Claims, 11 Drawing Figures

Fig.9.: TIME IN MILLISECONDS APPROXIMATELY.
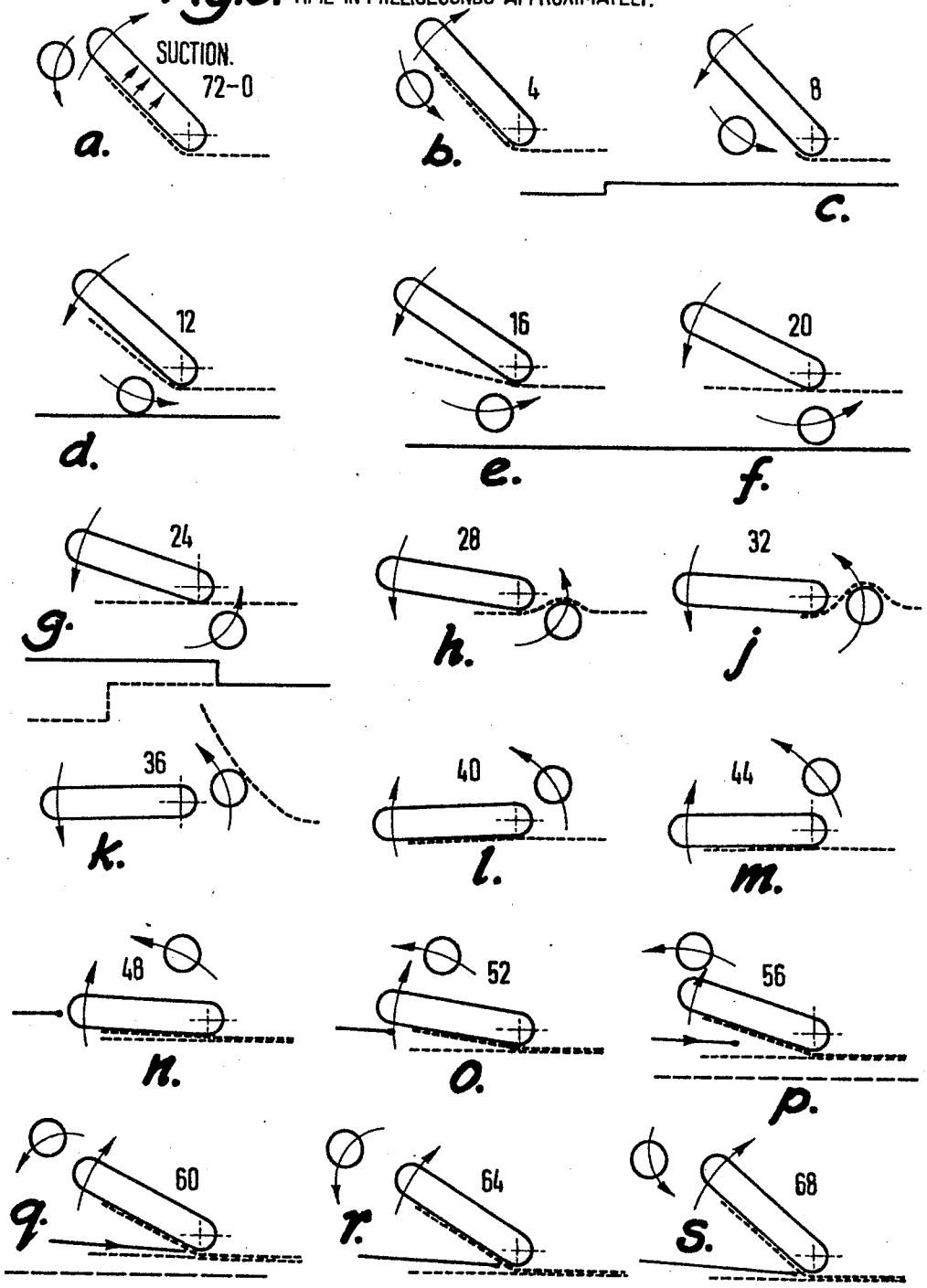

APPARATUS FOR COUNTING A STACK OF SHEETS

U.S. Pat. No. 3,838,255 by the present applicant also discloses and claims an apparatus of the kind described.

FIELD OF THE INVENTION

The invention relates to apparatus for counting a stack of sheets.

DESCRIPTION OF THE PRIOR ART

British Pat. No. 557,086 discloses apparatus, for counting a stack of sheets, of the kind (hereinafter referred to as "the kind described") comprising a counting head which in use is traversed along a corner of the stack, the head having a suction blade provided with a suction orifice for insertion in the corner of the stack, which blade is oscillatable about a horizontal axis to separate a corner of a sheet in the stack adhered by suction to one side of the blade from the next sheet, and a wiping pin movable in an elongate orbit around the blade to transfer the corner of the sheet from the said one side of the blade to the opposite side thereof, and means to count the number of transfer operations effected.

SUMMARY OF THE INVENTION

The invention provides an apparatus of the kind described, wherein there are provided means to traverse the counting head downwardly past a corner of a stack to be counted and means to move said wiping pin in a generally downwardly inclined elliptical orbit around the suction blade, comprising first means to mount the wiping pin for eccentric rotation about a first axis, second means to mount said first mounting means for eccentric rotation about a second axis, and means to drive said first and second mounting means about said first and second axes respectively.

The means to drive the first mounting means may comprise a pinion fixed to said mounting means in mesh with an internally toothed gear so that as the first mounting means is rotated by the second mounting means the pinion orbits said internally toothed gear, rotating the last mounting means.

In one embodiment said internally toothed gear is fixed in which case the pin has a simple elliptical orbit.

In a second embodiment means are provided to oscillate the internally-toothed gear in timed relation with said mounting means so that the major axis of the ellipse curves towards the horizontal at the lower extremity thereof and a concavity is formed in the upper part of the path adjacent said lower extremity.

In any of the arrangements referred to above the wiping pin is freely mounted for rotation about its longitudinal axis on said first mounting means.

BRIEF DESCRIPTION OF THE DRAWINGS

One example of the invention will now be described by way of example only and with reference to the accompanying drawings in which:

FIG. 9 shows, in a series of diagrams, the cycle undergone by the suction blade and wiping arm during a counting operation;

DESCRIPTION OF THE PREFERRED EMBODIMENT

Figure 1:
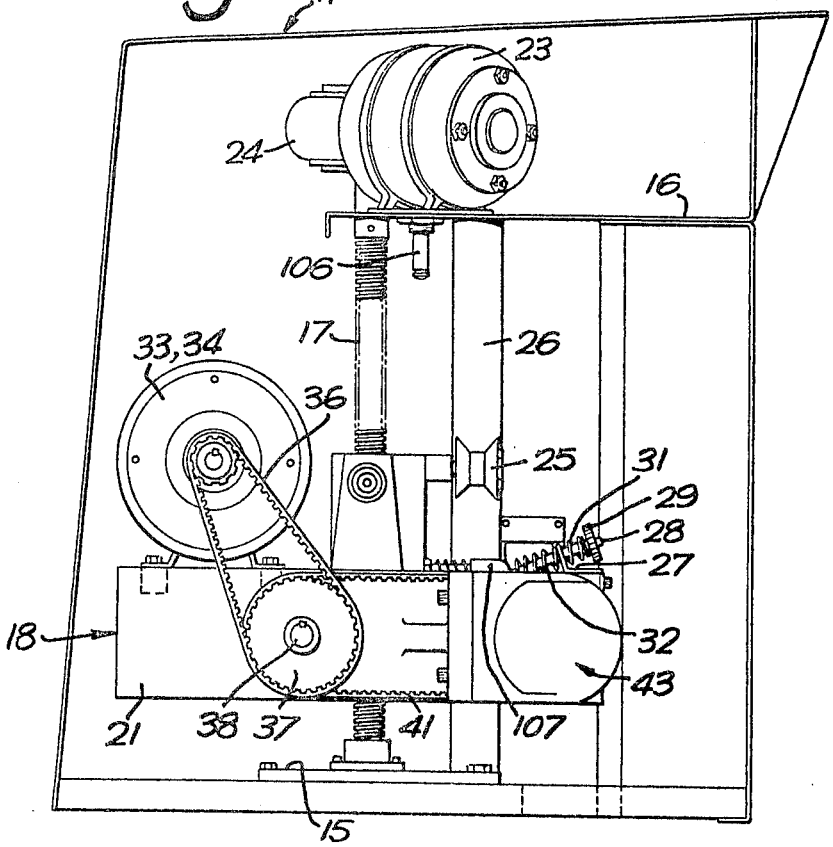
FIG. 1 is a side elevation of an apparatus embodying the invention.
Figure 2:
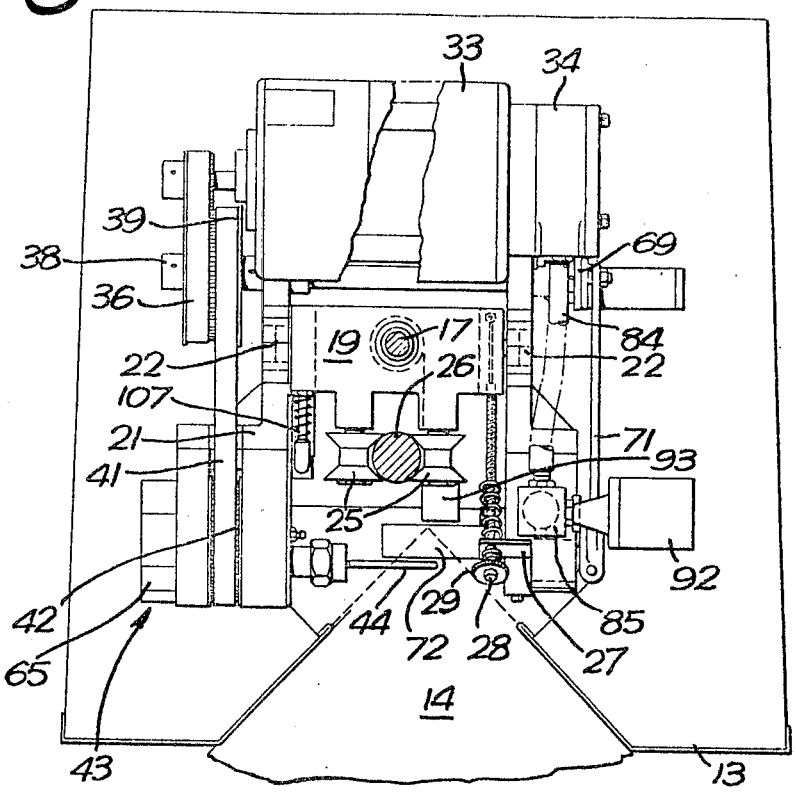
FIG. 2 is a plan view of the apparatus of FIG. 1.

The apparatus shown in FIGS. 1 and 2 is a sheet-counting machine and is mounted inside a sheet metal casing indicated generally at 11. The front panel 13 of this casing is formed with a wide Vee-entry to receive the corner of a horizontally-placed stack 14 of paper sheets (only part of which is shown).

The machine includes a base 15 and an upper platform 16, between which an acme-threaded leadscrew 17 extends vertically. The leadscrew supports a counting head 18 via a block 19, to which the counting head chassis 21 is pivotally attached at 22 and through which the leadscrew passes. A leadscrew motor 23 (not shown in FIG. 2), which is conveniently a small electric motor, is mounted on the upper platform 16 of the machine and is connected through reduction gearing housed in a gearbox 24 to drive the leadscrew 17.

Two flanged rollers 25 are freely rotatable on shafts which project from the block 19 on either side of the leadscrew axis, and embrace a circular steel column 26. The column 26 extends vertically, in a direction parallel to that of the leadscrew 17, between the base 15 and the upper platform 16, and it and the rollers 25 constrain the block 19 to move along the axis of the leadscrew 17 without rotating about that axis. A bracket 27, upstanding from the counting head chassis 21, carries a finely-threaded adjustable screw 28 and a knurled adjusting ring 29, one end of the screw entering a hole threaded into the block 19 and the other passing through the upstanding bracket 27 and being held against one side of the bracket by the ring 29. Two helical compression springs 31 and 32 encircle the screw, the spring 31 being of greater spring rate than the spring 32, and with this arrangement the counting head 18 can be accurately balanced about the pivot 22 by turning the adjusting ring 29.

A second electric motor 33 is mounted on the counting head chassis 21 and is combined with a rotary vane suction pump 34 to form a compact unit for the dual functions of driving the wiping arm of the machine and supplying suction pressure to the machines suction blade. A toothed gear 35 on the output shaft of the motor 33 drives, through toothed belting 36, a sprocket 37 secured to a layshaft 38 rotatably mounted in the counting head chassis 21, and if a 2,800 r.p.m. electric motor 33 were to be used then a gear reduction of about 3.3 to 1 might be chosen, giving a layshaft speed of say 855 r.p.m. during a counting operation. A second sprocket 39 is secured to the layshaft and transmits the drive through toothed belting 41 and a third sprocket 42 to a gear mechanism, shown generally a 43, which drives the wiping arm 44 of the machine. The sprockets 37, 39 and 42 are of the same diameter and thus do not alter the initial gear reduction when transmitting the drive to the gear mechanism 43.

Figure 4:
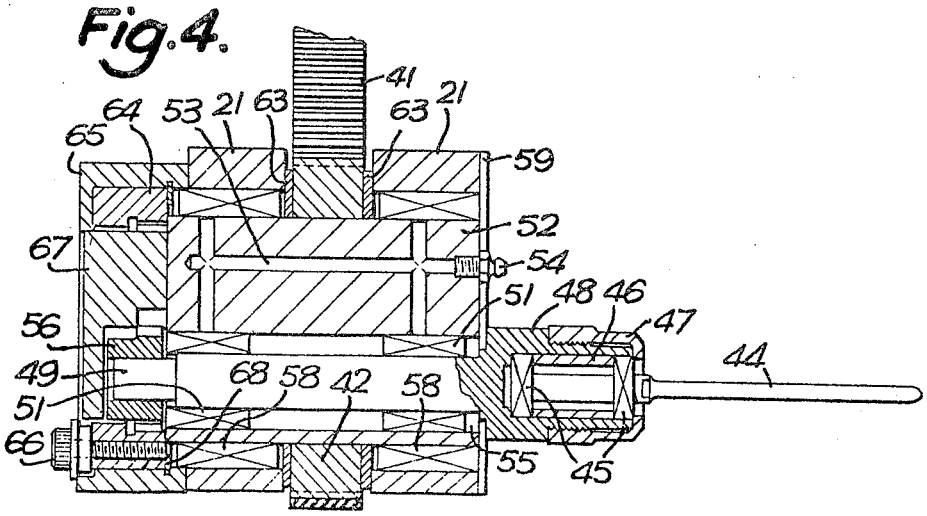
FIG. 4 shows the mechanism of FIG. 3 in section.
Figure 3:
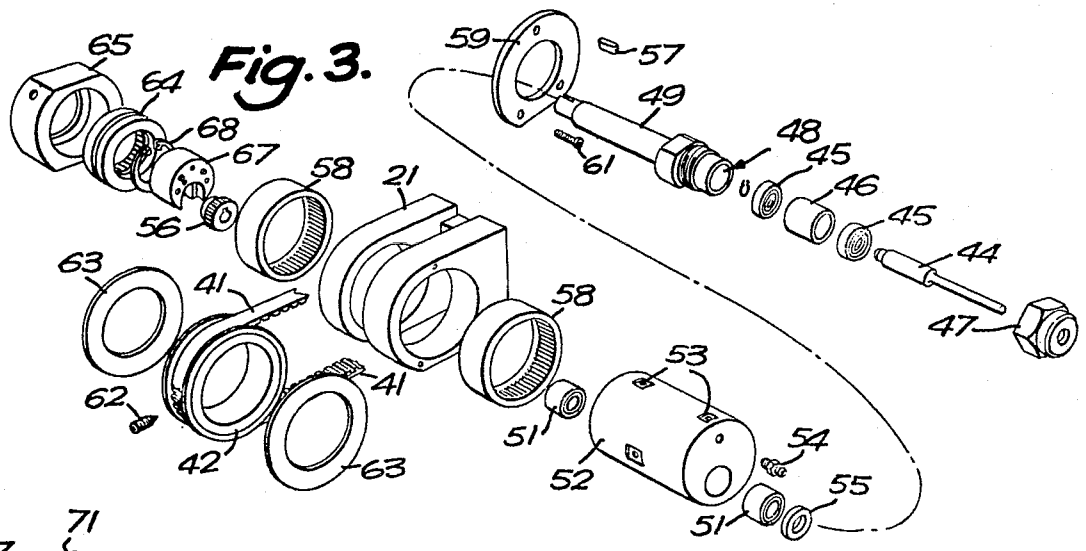
FIG. 3 is an exploded view showing parts of the gear mechanism which drives the wiping arm of the apparatus.

FIGS. 3 and 4 show in detail the gear mechanism 43 and the parts associated with the wiping arm 44. The arm is in the form of a pin and is freely rotatable in two rolling bearings 45 carried in a sleeve 46, which is in turn held, by a cap 47, in a housing 48 formed as an extension of a shaft 49. This shaft also runs in rolling bearings 51 eccentrically mounted in a barrel 52. Passageways 53 are drilled in the barrel to admit lubricating oil or grease to the bearings 51, the lubricant being applied via a nipple 54. A spacing washer 55 completes this portion of the assembly.

A toothed pinion 56 is secured by a key 57 to the other end of the shaft 49, restraining endwise movement of the shaft within the barrel, and the barrel-and-shaft assembly is supported in rolling bearings 58 in the counting head chassis 21 and is retained in position by a plate 59 and screws 61. The sprocket 42 is secured to the barrel by a grub screw 62, and spacing washers 63 act as oil-retaining seals.

An internally toothed gear ring 64 is held within a housing 65 and the housing is located and held by an allen screw and washer 66 against the end of the chassis 21. The pinion 56 meshes with the teeth of the ring 64, and a button 67 — held within the ring 64 by a circlip 68 — locates the pinion during movement of the gear mechanism.

Figure 5:
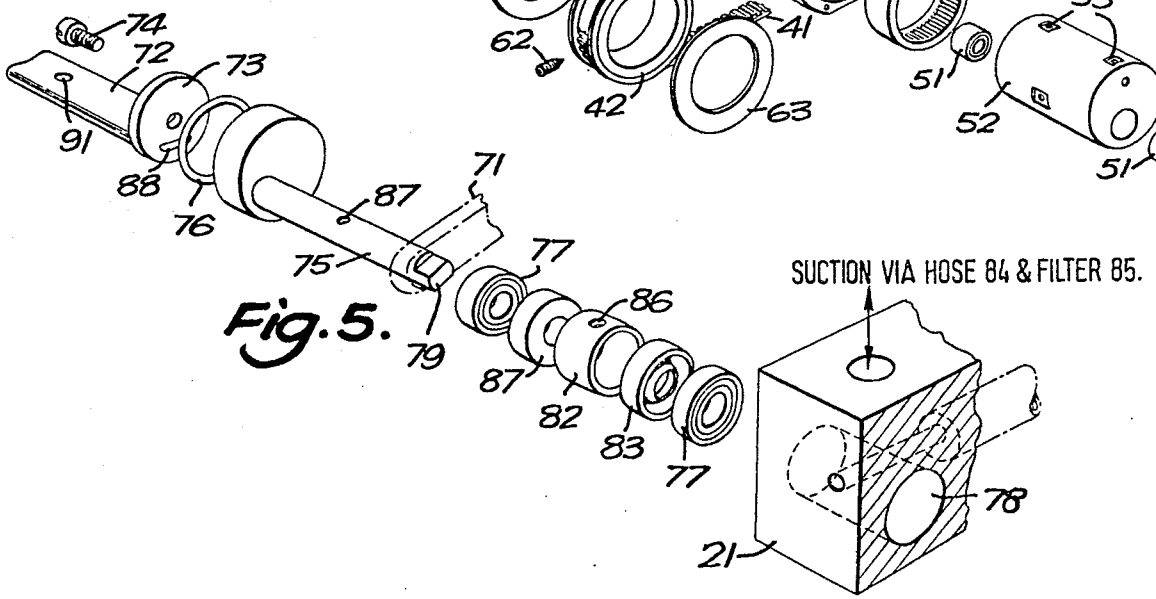
FIG. 5 is another exploded view showing parts associated with the suction blade of the apparatus.

The layshaft 38 of the machine, in addition to carrying the toothed sprocket 37 at one end, carries at its other end a disc 69 as shown in FIG. 2, and this disc 69 is connected by a rigid pivoted link 71 to drive the oscillatable suction blade of the machine. FIG. 5 shows in detail the suction blade and its associated parts. The blade 72 is hollow, and concave on its sheet-contacting face, and is formed eccentrically on a disc 73 secured by a screw 74 to the end flange of a shaft 75. A washer 76 is sandwiched between the disc 73 and this flange, which is eccentric to the shaft 75. The shaft is supported in rolling bearings 77 in a bore 78 in the counting head chassis 21, with the link 71 fitting over a spigot 79 on the end of the shaft and, together with the bearings 77 and the inside face of the aforementioned flange, retaining the shaft in its bore. A collar 81, and rings 82 and 83, complete this portion of the assembly.

Referring to FIG. 2 in conjunction with FIG. 5, it will be seen that a short vacuum hose 84 connects the output of the pump 34, through a filter block 85, with passageways 86, 87 and 88 so that the pump can supply suction pressure to the blade 72. A hole 91 in the concave face of the blade communicates this suction pressure to successive sheets during a counting operation. A vacuum-operated switch 92 is connected to the filter block 85 and thus to the suction pressure supply.

Figure 6:
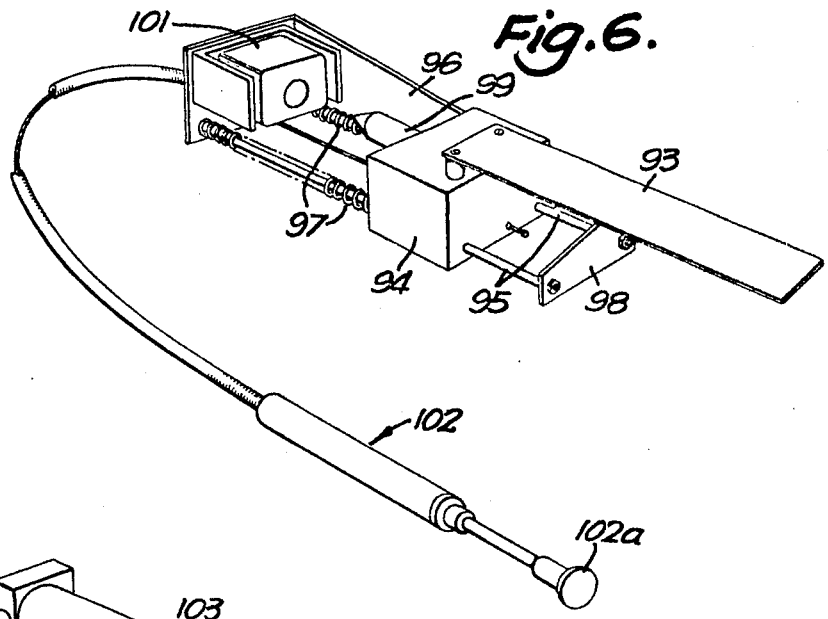
FIGS. 6, 7 and 8 are perspective views showing alternative forms of the interrupting blade retainer of the apparatus.

The machine includes an interrupting blade (whose function will later be described) and FIG. 6 shows one form of the blade and its operating mechanism. The blade 93 — also marked in FIG. 2 — is of thin spring steel plate fastened to a fibre block 94 which slides on guide rods 95 in a frame 96. The frame 96 is secured to the counting head chassis 21, and its positioning in relation to the suction blade will become apparent from the later FIG. 9 of the drawings. Helical compression springs 97 surround the guide rods 95 and urge the blade outwards along the guide rods towards the frame end stop 98. A steel plunger 99 extends from the block 94 and fits within the cobalt core of an electromagnet 101 fixed to the frame 96. During a counting operation, the plunger is held within the energised electromagnet, holding the blade 93 in a retracted position against the action of the springs 97. A hand-operable cable control indicated generally at 102 is provided for retracting the plunger 99 back into the electromagnet after the blade 93 has been fired across the corner of the stack in a manner hereinafter described. The operating button 102*a* of this control is mounted on the front panel 13 of the casing 11 shown in FIGS. 1 and 2.

Figure 7:
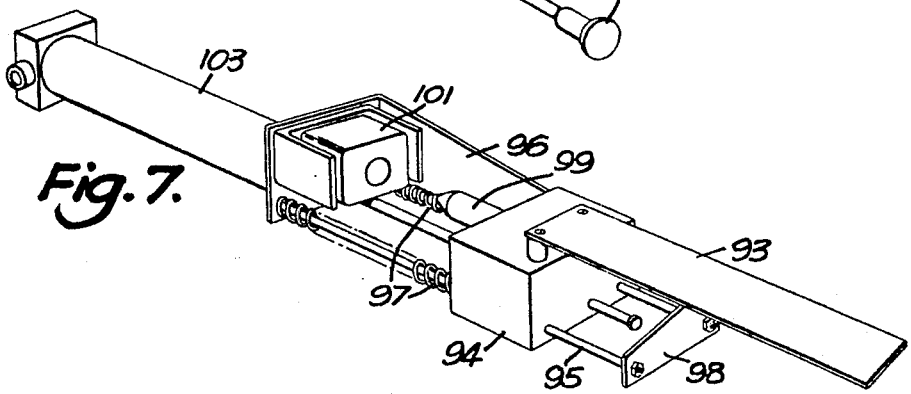
Figure 8:
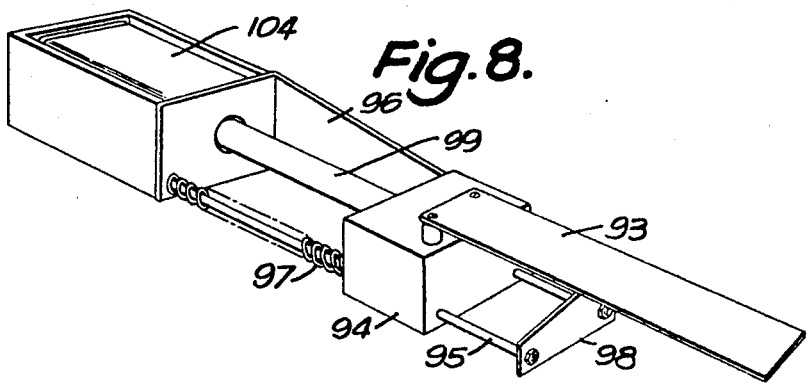

FIG. 7 shows another form of interrupting blade mechanism, usable with the machine, in which an air cylinder 103 retracts the plunger after firing and the blade is fired by a solenoid trigger. In a further variant, shown in FIG. 8, the plunger is extended so that the solenoid 104, in addition to firing the blade, can also be used to retract it.

Figure 10:
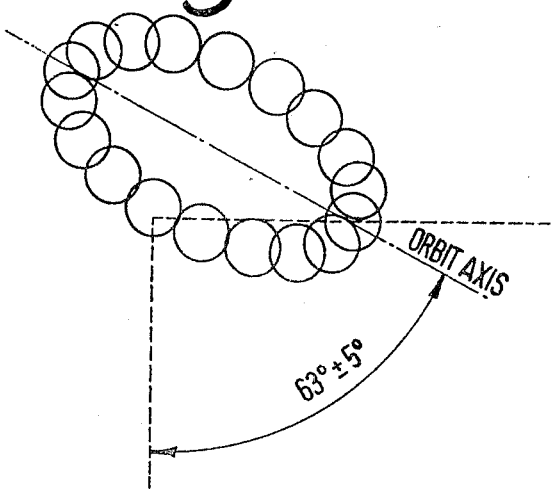
FIG. 10 shows, diagrammatically, the angle which the major axis of the wiping arm orbits preferably makes with the vertical edge of the uncounted stack during a counting operation.

FIG. 9 shows, diagrammatically, the operation of the machine. A stack 14 of paper sheets is arranged horizontally as in FIG. 2 so that the machine operates at the corner of the stack, and the leadscrew 17 is driven by the motor 23 to bring the counting head 18 to a position where the suction blade 72 can pick up the top sheet of paper (shown in FIG. 9 in broken line). The motor-and-pump unit 33, 34 is then operated, and the drives to the blade 72 and wiping arm 44 cause the blade to oscillate about its leading edge 105 (FIG. 9) and the wiping arm to move round it in a closed, substantially elliptical orbit shown in stages in FIG. 9 and in locus in FIG. 10. The major axis of this orbit is approximately twice the minor axis, and the shape of the orbit gives adequate clearance for the wiping arm around the leading and trailing edges of the suction blade without excessive penetration of the arm into the stack. As shown in FIG. 10, the major axis makes an angle of approximately 63° (±5°) with the vertical edge of the uncounted stack of sheets.

Referring to FIGS. 1, 2 and 9; a plunger-operated microswitch 106 mounted underneath the upper platform 16 stops the leadscrew-driving motor 23 at a predetermined desired maximum height of the counting head 18 if the top of the block 19 strikes the plunger. When counting begins, the motor-and-pump unit 33, 34 drives the wiping arm and suction blade and the operation of counting the first few sheets causes the balanced head 18 to pivot slightly clockwise (as viewed in FIG. 1). When the head has pivoted by a predetermined, very small, amount, a microswitch 107 sends a drive signal to the other motor 23, causing the leadscrew 16 to be turned a predetermined amount and lowering the head 18 to restore the balance. This cycle of movements is then repeated, and in this way the head moves vertically down the stack in a series of rapid, successive swinging and lowering motions.

FIG. 9 shows the counting cycle of the wiping arm and suction blade. As the arm exits from the stack around the trailing edge of the blade, a layshaft—operated contact (not shown in the drawings) is closed and when the suction pressure operates — that is, when a sheet corner is not adhering to the blade over the suction hole — the vacuum operated switch 92 is also closed. The two switches are wired in series to an electronic counter (not shown) and, when they are both closed, a "count" signal is generated and transmitted to the counter. Thus, for every revolution of the wiping arm and every sheet corner picked up by the suction blade, a count signal is generated as the head 18 works its way down the stack.

When all but one of a predetermined number of count signals have been transmitted to the counter, the suction blade picks up the corner of the last sheet to be counted, a second set of contacts (not shown) is closed and the interrupting spring blade trigger is released by reversing the polarity of the electromagnet. The blade (93 in FIG. 6) shoots out under the action of the compressed springs 97 to lie on top of the uncounted stack and thus under the suction blade, as shown in FIGS. 9*n* to *s*. The pin containues round in its orbit, passing between the spring blade and the suction blade to transfer the last sheet corner from the underside to the topside of the blade, and the last count signal is transmitted. When the suction blade next comes down it will adhere to the topside of the spring blade and will be unable to lift it. The suction blade will stop, the vacuum-operated switch 92 remain open, no count signal will be transmitted to the counter and the wiping pin will be stopped automatically. The counted sheets can then be removed from the stack and the spring blade retracted for the next counting operation to begin.

Figure 11:
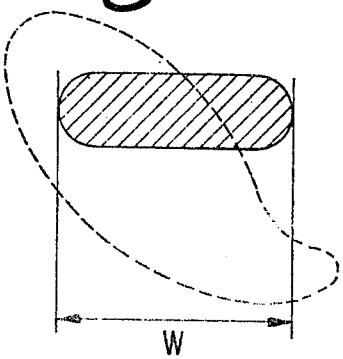
FIG. 11 shows, in-broken line, the orbit of the wiping arm of an apparatus embodying the invention but having an alternative form of wiping arm drive.

FIG. 11 shows, in broken line, the wiping arm orbit of a machine embodying the invention, in which the sprocket 37 has a rigid link (not shown in the drawings) pivoted eccentrically to it and also pivoted to the outside of the housing 65, in a manner similar to that of the link 71 connecting the parts 69 and 79 in the suction blade drive. In this embodiment, the housing 65 is not fixed with respect to the chassis 21 but can be oscillated through a small arc by the rigid pivoted link (not shown) when the motor 33 is operated. This causes oscillation of the internally toothed gear ring 64 about its central axis, and the wiping arm orbit is modified to that shown in FIG. 11. With this orbit, a suction blade of slightly greater width than in the embodiment so far described could be used, to cater for misalignment of the sheet corners, although the less purely elliptical shape of the orbit and hence the greater degree of penetration of the arm into the stack could result in unacceptable curling of the sheet corners with certain grades of paper sheet.

In a typical example, the standard blade width W with the orbit of FIGS. 9 and 10 might be ⅝ inch, in which case a ¾ inch wide blade might be tried with the arrangement of FIG. 11.

It is thought that a machine embodying the invention could be mountable on a bench (for example the embodiment shown in the drawings) for counting separate reams of paper sheets; or alternatively trolley-mounted, or slung from an overhead travelling gantry, for counting stacks of sheets in a warehouse.

I claim:

1. Apparatus for counting a stack of sheets, comprising in combination:

a. a counting head which is adapted to be traversed along a corner of a stack of sheets;

b. a suction blade having a suction orifice for insertion into the corner of such stack;

c. a wiping pin;

d. means mounting said suction blade and said pin on said head for movement therewith along the corner of the stack;

e. means to oscillate said blade about a corner of a sheet in the stack adhered by suction to one side of the blade from the next sheet;

f. means to move said pin in an elongate orbit around said blade to transfer the said corner of the sheet from the said one side of the blade to the opposite side thereof;

g. means to count the number of transfer operations effected;

h. means to traverse the counting head downwardly past a corner of a stack to be counted; and, i. means for moving said wiping pin in a generally downwardly inclined elliptical orbit around the suction blade, said moving means comprising a first means for mounting the wiping pin for eccentric rotation about a first axis, a second means for mounting said first mounting means for eccentric rotation about a second axis, means to drive said second mounting means about the second axis, and means to drive the first mounting means about said first axis comprising a pinion fixed to the first mounting means in mesh with an internally toothed gear so that as the first mounting means is rotated with the second mounting means the pinion orbits said internally toothed gear so as to rotate the first mounting means.

2. The apparatus of claim 1 wherein said internally toothed gear is fixed and the pin has a simple elliptical orbit.

3. Apparatus for counting a stack of sheets, comprising in combination:

a. a counting head which is adapted to be traversed along a corner of a stack of sheets;

b. a suction blade having a suction orifice for insertion into the corner of such stack;

c. a wiping pin;

d. means mounting said suction blade and said pin on said head for movement therewith along the corner of the stack;

e. means to oscillate said blade about a corner of a sheet in the stack adhered by suction to one side of the blade from the next sheet;

f. means to move said pin in an elongate orbit around said blade to transfer the said corner of the sheet from the said one side of the blade to the opposite side thereof;

g. means to count the number of transfer operations effected;

h. means to traverse the counting head downwardly past a corner of a stack to be counted; and, i. means for moving said wiping pin in a generally downwardly inclined elliptical orbit around the suction blade, said moving means comprising a first means for mounting the wiping pin for eccentric rotation about a first axis, a second means for mounting said first mounting means for eccentric rotation about a second axis, means to drive said second mounting means about the second axis, means to drive the first mounting means about said first axis and comprising a pinion fixed to the first mounting means in mesh with an internally toothed gear so that as the first mounting means is rotated with the second mounting means the pinion orbits said internally toothed gear, rotating the first mounting means and means for oscillating the internally toothed gear in timed relation with said second mounting means so that the major axis of the ellipse curves towards the horizontal at the lower extremity thereof and a concavity is formed in the upper part of the path adjacent said lower extremity.

4. The apparatus of claim 3 wherein the wiping pin is freely mounted for rotation about its longitudinal axis on said first mounting means.

5. Apparatus for counting a stack of sheets, comprising in combination:

a. a counting head which is adapted to be traversed along a corner of a stack of sheets;

b. a suction blade having a suction orifice for insertion into the corner of such stack;

c. a wiping pin;

d. means mounting said suction blade and said pin on said head for movement therewith along the corner of the stack;

e. means to oscillate said blade about a corner of a sheet in the stack adhered by suction to one side of the blade from the next sheet;

f. means to move said pin in an elongate orbit around said blade to transfer the said corner of the sheet from the said one side of the blade to the opposite side thereof;

g. means to count the number of transfer operations effected;

h. means to traverse the counting head downwardly past a corner of a stack to be counted; and, i. means to move said wiping pin in a generally downwardly inclined elliptical orbit around the suction blade, comprising first means to mount the wiping pin for eccentric rotation about a first axis, second means to mount said first mounting means for eccentric rotation about a second axis, means to drive said first and second mounting means about said first and second axes respectively, and means for cyclically moving the position of said first axis so that the major axis of the ellipse curves towards the horizontal at the lower extremity thereof and a concavity is formed in the upper part of the path adjacent said lower extremity.

* * * * *